United States Patent [19]

Perdue

[11] 3,966,045

[45] June 29, 1976

[54] SKIN PACKAGE

[75] Inventor: Richard R. Perdue, Greer, S.C.

[73] Assignee: W. R. Grace & Co., Duncan, S.C.

[22] Filed: May 12, 1975

[21] Appl. No.: 576,411

[52] U.S. Cl. ..... 206/443; 206/461; 206/471; 206/497

[51] Int. Cl.[2] ..... B65D 73/00; B65D 85/20

[58] Field of Search ..... 206/45.33, 205, 258, 206/443, 461–463, 466, 471, 484, 497, 526; 229/DIG. 12

[56] References Cited

UNITED STATES PATENTS

| | | | |
|---|---|---|---|
| 2,779,465 | 1/1957 | Anderson | 206/461 X |
| 3,231,083 | 1/1966 | Rumsey, Jr. | 206/497 |
| 3,343,897 | 9/1967 | Keller | 206/216 X |
| 3,761,289 | 9/1973 | Wolf | 206/497 X |

FOREIGN PATENTS OR APPLICATIONS

| | | | |
|---|---|---|---|
| 1,280,053 | 11/1961 | France | 206/463 |

*Primary Examiner*—Steven E. Lipman
*Attorney, Agent, or Firm*—John J. Toney; William D. Lee, Jr.

[57] ABSTRACT

A package having a single backing or support member with products skin packaged to opposite sides of said support member.

12 Claims, 6 Drawing Figures

SKIN PACKAGE

FIELD OF THE INVENTION

This invention relates generally to skin packaging and specifically to vacuum skin packaging of both food and non-food items.

BACKGROUND OF THE INVENTION

Skin packaging is essentially a vacuum forming process; and, in a typical prior art process, a sheet of thermoplastic film is placed in a frame, and below the frame is a vacuum plate upon which a piece of backing board or a supporting member is placed. The product to be skin packaged is positioned on top of the backing board and heat is applied to the thermoplastic film in the frame. When the film has been heated to become sufficiently soft, the frame is lowered and the plastic sheet drapes itself over the product. As this happens, a partial vacuum is created through the vacuum plate and the air underneath the plastic film is withdrawn through the backing board. The air pressure differential between the top and bottom of the plastic sheet causes the sheet to be tightly pressed around the product. The film may be coated with an adhesive or the backing board may be so coated. Where the two contact each other, a strong bond is formed resulting in a package in which the product is tightly held to the backing board for safe shipping and for subsequent rack display in retail stores.

Vacuum skin packaging differs from the above described skin packaging process in that both thermoplastic film and the backing board are impervious to gases and the resulting package can be evacuated and hermetically sealed, if desired. The same end result is sought, i.e. the product is to be tightly held by transparent film to the backing board. The conventional method employs a backing board which is porous or which is perforated so that the vacuum may be drawn directly through the backing board. The vacuum skin packaging process generally employs a vacuum chamber with an open top. The product on a impervious backing board is placed on a platform within the vacuum chamber. The top of the chamber is then covered by a sheet of film which is clamped tightly against the chamber to form a vacuum type closure. The chamber is evacuated while the film is heated to forming and softening temperatures. The platform can then be raised to drive the product into the softened film and air pressure can be used above the film to force it tightly around the product. This type of process is disclosed in French Pat. No. 1,258,357 issued to Alain G. Bresson on Mar. 6, 1961. A refinement to the process described in the Bresson French patent is disclosed in French Pat. No. 1,286,018 which issued on Jan. 22, 1962 to Laroach Freres, Ltd. In the Laroach Freres process, after the chamber has been evacuated and the product driven into the heat softened film, the vacuum is released and ambient air is permitted to enter the chamber so that the thermoplastic film molds more or less on the product since there is a vacuum on the product side of the film and ambient air pressure on the other side of the film.

In Australian Pat. No. 245,774 which issued to Colbro Proprietary Ltd. and Cole and Son Proprietary Ltd. on July 16, 1963, a vacuum skin packaging process is described in which an article to be packaged is inserted within the lower half of a vacuum chamber on a backing board, a thermoplastic film is placed over the open face of the lower half of the chamber, the chamber is closed and both halves are brought to essentially the same state of vacuum, the film heated and softened, and then atmospheric air is introduced into the upper half of the chamber so that it alone forces the thermoplastic film down around the product and against the backing board.

Still another variation of the vacuum skin packaging process which can be found in the prior art is that disclosed in U.S. Pat. No. 3,491,504 which issued to W. E. Young et al on Jan. 27, 1970. The Young patent discloses a process in which the softened film can be physically moved down over a stationary product and, in combination with air pressure, the softened thermoplastic film will be molded onto the product.

In U.S. Pat. No. 3,694,991 which issued on Oct. 3, 1972 to Richard R. Perdue et al, a vacuum skin packaging process is disclosed in which the product to be packaged is placed on a gas impervious supporting member, a flexible sheet is shaped into a concavity, and this sheet is positioned over the product covering same but not contacting either the product or the supporting member. Next, gases are evacuated from the space between the sheet and supporting member and then the sheet is moved from its concave position so that it closely contacts the product and supporting member so that the sheet may be sealed against the supporting member. Also, in U.S. Pat. No. 3,736,721 issued on June 5, 1973 to Robert O. Wolfelsderger, a vacuum skin packaging process is disclosed in which the backing board or support member is eliminated and the product is entirely sealed within two film portions which meet in a peripheral sealed in the midplane of the product. Thus, film sheet is vacuum formed to conform to the shape of both the upper half and the lower half of the product.

In each of the foregoing described prior art vacuum skin packaging processes, a skin package is formed on only one side of a support member of film member. It is one object of the present invention to provide a skin package in which products are skin packaged to both sides of a single film or supporting member.

It is another object of the present invention to provide a vacuum skin package in which one portion of the package may be opened without destroying the hermetic seal enclosing the products in the remainder of the package.

It is yet another object of the present invention to provide a skin package which makes use of a single, central support member thereby effecting a saving in materials and energy to produce the package.

It is yet another object of the present invention to provide a novel skin package which was not heretofore available in the art.

All of the foregoing listed advantages and others will be readily apparent to those conversant in the art of skin packaging from the following summary of the invention and detailed description.

SUMMARY OF THE INVENTION

In one aspect, the present invention is a package comprising a support member and products held securely to opposed sides of the support member, each product being held by a film member which closely conforms to the shape of the product, said film member being sealed to said support member around the periphery of each respective product.

In another aspect, the present invention is a package comprising a gas impervious support member; product positioned on both sides of said support member; and, gas impervious sheets partially enclosing and conforming to the shape of each product, each sheet holding the respective product in position and a portion of each sheet being hermetically sealed to said support member arouund the periphery of each product.

In still another aspect, the present invention is a skin packaging method comprising the steps of: forming a vacuum skin package on one side of an impervious backing member, and forming a vacuum skin package on the other side of the impervious backing member.

In yet another aspect, the present invention is a method of skin packaging comprising the steps of providing a support member and the products to be packaged; positioning at least one product on one side of the support member; positioning a first sheet of flexible film so that the product is between said sheet and said support member; evacuating gases from the space between the first sheet and said support member; enveloping said product with said first sheet so that said first sheet contacts said support member around the periphery of said product and said first sheet closely conforms to the shape of said product; hermetically sealing said first sheet to said supporting member where it contacts same; positioning at least one other product on the other side of said support member; positioning a second sheet of flexible film so that said other product is between said second sheet and said support member; evacuating gases from the space between said second sheet and said support member; enveloping said other product with said second sheet so that said second sheet contacts the support member around the periphery of the other product and said second sheet closely conforms to the shape of said other product; and, hermetically sealing said second sheet to said supporting member where it contacts same thereby forming skin packages on opposed sides of said support member.

DESCRIPTION OF THE DRAWINGS

In the drawings which form a part of this specification.

PREFERRED EMBODIMENTS

Figure 1:
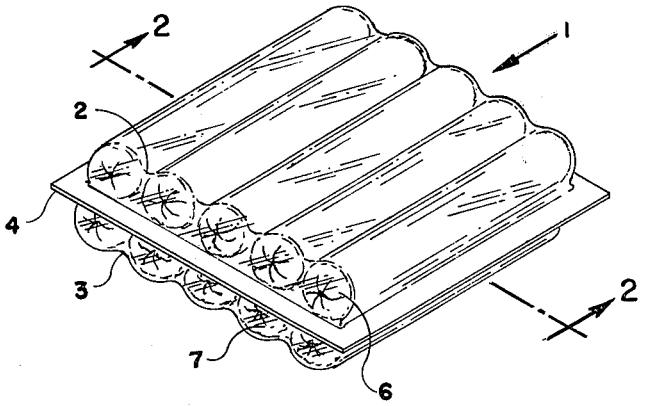
FIG. 1 is a perspective view of a package according to the present invention.
Figure 2:
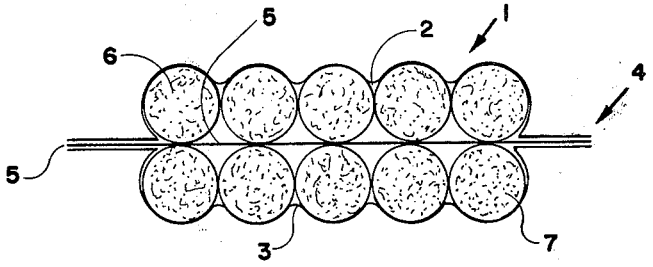
FIG. 2 is a view taken along line 2—2 of FIG. 1.
Figure 3:
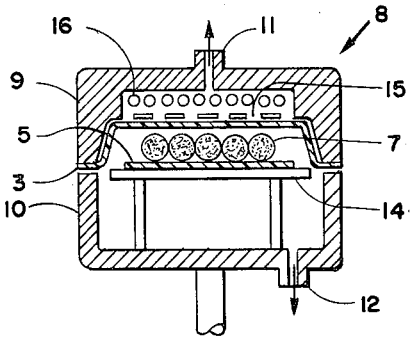
FIG. 3 is a schematic representation of a section through a vacuum chamber in which the product to be packaged has been placed on a support member with a film sheet positioned thereover in one of the first steps in the method according to the present invention.

Referring first to FIGS. 1 and 2 one preferred embodiment of a package according to the present invention is shown. The double vacuum skin package 1 comprises backing or support member 5 which is preferably a gas impervious thermoplastic sheet material which has products 6 on one side thereof and product 7 on the other. As illustrated in FIGS. 1 and 2, products 6 and 7 are frankfurters and there is an equal number of frankfurters on both sides of support member 5. However, more of the product could be placed on one side of the support member 5 than on the other and even unlike products could be packaged with one product on one side of the support member and another on the other such as sliced cheese on one side of support member 5 and sliced luncheon meat on the other.

Still referring to FIGS. 1 and 2, products 6 and 7 are held securely to support member 5 by upper covering web 2 and lower covering web 3 which tightly enclose and envelop the product on each side of the support member 5 and closely conform to the shape of the product. The covering web is preferably a transparent, heat formable, gas impervious thermoplastic web. Both the upper web 2 and lower web 3 are sealed to support member 5 to form peripheral flange 4 around the midplane of the skin package 1. The contact surfaces of covering webs 2 and 3 may be coated with a heat activatable adhesive to form the seal around flange 4 or there may be an adhesive which is either a pressure sensitive adhesive or heat activatable adhesive applied to both sides of the support member 5 so that the webs 2 and 3 will seal thereto. Also, if the package is formed by heating webs 2 and 3 the web material may be of the type that is sealable to backing member 4 without the presence of an additional adhesive.

Support member 5 need not always be flat or substantially flat as it could be a tray with compartments with products skin packaged to both side of the tray or it could be a curved surface either convex or concave having products skin packaged to either side thereof.

One preferred material for the support member 5 is polystyrene foam which is opaque or a clear material such as oriented polystyrene or polyethylene may be used. If a high degree of gas impermeability is desired, the support member 5 may be a thermoplastic laminate employing a layer of vinylidene chloride copolymer or ethylene vinyl alcohol. Other impervious backing members may be metal foil or metal sheet, coated or laminated paper or wood sheets, or glass.

One of the chief advantages to a package according to the present invention and as illustrated in FIGS. 1 and 2 is that upper covering web 2 may be peeled back from the supporting member 5 from the flange area 4 so that product 6 may be removed from the upper half of the package and the hermetic or vacuum seal on the lower half of the package is not disturbed so that the contents thereof remain fresh and unexposed to atmospheric air. Use is thereby made of the support member 5 as a common wall for two separate packages thereby effecting a savings in material and time for preparing the package.

Figure 4:
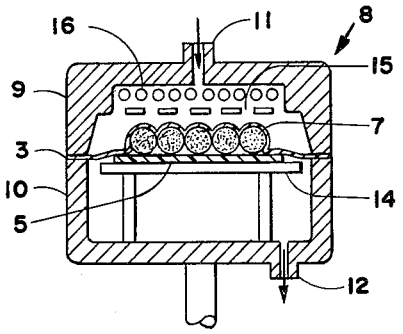
FIG. 4 shows the same vacuum chamber as in FIG. 3 with the film enveloping the product on the backing member to form a skin package one one side thereof.

Turning now to FIGS. 3, 4, 5, and 6 the preferred method of the present invention will be described. Looking first at FIG. 3, a section through vacuum chamber 8 having an upper chamber half 9 and a lower chamber half 10 is shown. The upper chamber half can be removed in order to move packaging materials into and out of the chamber and the upper half 9 can be closed upon lower half 10 in order to preserve the vacuum inside the chamber during a skin packaging process. Inside the chamber is seen support platform 14 whose height may be adjusted according to the height of the product to be packaged. On platform 14 is placed backing material or support member 5 and positioned or support member 5 is product 7 which, in this instance, are frankfurters shown in transverse sections. Upper web 3 is positioned so that the product 7 is between it and the support member 5. In this preferred embodiment, upper web 3 is held in position by vacuum drawn through film holding ports 15 and through upper chamber evacuation port 11. While film 3 is held in this position with the chamber sealed and closed, vacuum is drawn through lower chamber evacuation port 12 to completely evacuate the interior of the chamber and, hence, the gases from the space between the upper or first web 3 and the support member 5 are evacuated. Once this evacuation is completed to the level desired which may be to an interior chamber pressure of 29 inches of mercury below atmospheric or lower, the pressure differential which was responsible for holding film 3 against the upper part of the chamber is released so that the film 3 envelops the product and contacts the support member around the periphery of the product 7 and also the film 3 will closely conform to the shape of the product. This is illustrated in FIG. 4 where atmospheric air has been introduced to port 11 and pushes the film tightly down against the product due to the fact that the pressure on the upper side of film web 3 is at approximately atmospheric pressure and the pressure on the lower side is substantially below atmospheric. In the preferred embodiment, the film web 3 is thermoformable and as it has been held in position as in FIG. 3 against the upper chamber half, heating elements 16 have been activated to heat soften the film 3 so that when it is moved downwardly onto the product as shown in FIG. 4, the product will serve as a mold for the thermoformable film. The film web 3 may be coated with an adhesive which has been activated by the heating of the film or the support member 5 may be coated by a heat activatable adhesive which will become activated when it is contacted by the heated film. In either event, a seal is now formed between the film 3 and the support member 5 around the periphery of the product 7. Thus, the product 7 is enclosed in an evacuated package formed by from web 3 and support member 5.

Figure 5:
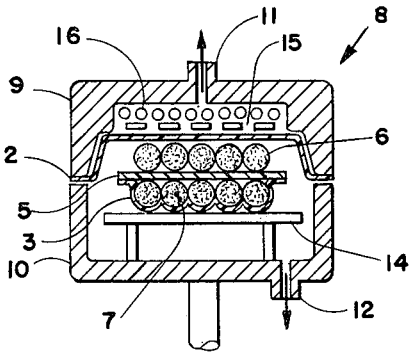
FIG. 5 is a section of the same vacuum chamber as in FIGS. 3 and 4 but with the previously formed package turned over so that additional product can be placed on the other side of the support member; and, FIG. 6 shows the formation of a package on the other side of the support member as the film envelops the product.

Turning now to FIG. 5, the partial package which had been prepared in FIG. 4 is shown turned upside down and product 6 has been positioned on backing member 5 and covering web 2 is positioned so that the product 6 is between it and backing member 5. Upper film web 2 is held in place by the vacuum applied through film holding ports 15 and upper chamber evacuation port 11. While in this position, covering web or film 2 which is preferably also a thermoformable, thermoplastic film, is heat softened by heaters 16 which may be either electrical resistance heaters or steam lines. At the same time that film 2 is held in position above product 6 the space between film 2 and backing member 5 is evacuated of all gases by the action of vacuum acting through port 12, both ports 11 and 12 being connected to suitable vacuum pumps. After the space between film 2 and support member 5 has been evacuated and the film web 2 sufficiently heat softened, port 11 is opened to atmospheric air and the pressure thereof drives the film 2 down onto the product and envelops same and contacts the support member around the periphery of product 6 where the film 2 is hermetically sealed to the backing member 5. Now, a complete package has been made in which product is secured to both sides of a single supporting member 5 by a skin packaging process with the result that the products on both sides of the backing member have been packaged under a vacuum and are hermetically sealed.

Figure 6:
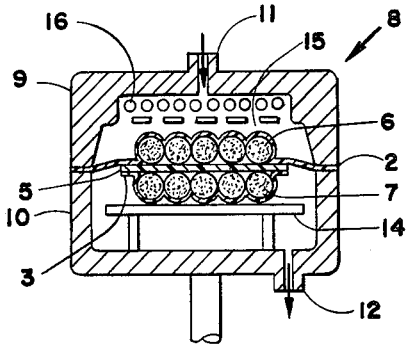

After the package which has been completed in FIG. 6 has been removed from vacuum chamber 8, the excess film 2 which extends outwardly beyond support member 5 may be trimmed off and a portion of the excess may be left to provide a tear tab so that the skin package on one side of the support member 5 may be readily opened without distrubing the skin package on the other side of the support member 5.

An alternate to the foregoing process would be to arrange the product and backing member inside a chamber similar to that shown in FIGS. 3–6 by placing a first sheet of flexible film or web on a support such as support 14, then place one product on the first film, a backing member on the product, another product on the backing member and a second sheet of film on top of the other product. Thereafter, the space between the two film webs is evacuated while the webs are restrained from moving. Then, both film webs are pushed onto the respective product and sealed around the respective peripheries to the opposite sides of the support member. Thus, the partial packages on both sides of the single support member may be simultaneously formed.

Instead of using two separate film webs or sheets as described in the paragraph immediately above, a single sheet can be folded in a U- or V-shape and a backing member with product disposed on opposite sides thereof may be placed between the folds of the single sheet, the sheet then completely sealed except for an evacuation opening, the space enclosed in the sheet may then be evacuated through the opening thus drawing the flexible sheet down tightly around the product on both sides of the backing member;, and, thereafter the evacuation port can be sealed off.

Suitable covering webs or sheets for use in the present invention are those made from thermoplastic materials such as polyethylene, ethylene vinyl acetate copolymers, polypropylene, nylon, polyvinyl chloride, polyvinylidene chloride, and the like. Laminates of these materials are preferred when a gas impervious sheet is desired, for example a laminate of polyethylene/saran/polyethylene provides low gas transmission. Also, nylon/polyethylene laminates are satisfactory as are laminates incorporating ethylene vinyl alcohol copolymers as the gas impervious layer.

As used herein, "gas impervious" or "gas impermeable" means a low gas transmission rate preferably a rate below 100cc/m$^2$/mil/24 hrs. at atmospheric pressure and 73°F.

Having thus described my invention, I claim:

1. A skin package comprising:

a. a gas impervious support member and two film members; and, b. products held securely to opposed sides of said support member, each product being held solely by a respective film member which includes a portion which conforms to the exact shape of the product, each of said film members being sealed to said support member around the periphery of each respective product.

2. The skin package of claim 1 wherein said support member is flat.

3. The skin package of claim 2 wherein a plurality of products are positioned on each side of said support member.

4. The skin package of claim 1 wherein a single product is positioned on one side of said support member and a plurality is positioned on the other side.

5. The skin package of claim 1 wherein said film member is transparent thermoplastic film.

6. The skin package of claim 5 wherein said support member is flat.

7. A package comprising:

a. a gas impervious support member;

b. product positioned on both sides of said support member but not adhered directly to said support member; and, c. gas impervious sheets partially enclosing and closely conforming to the shape of each product, each sheet holding the respective product securely in position and a portion of each sheet being hermetically sealed to said support member around the periphery of each product.

8. The package of claim 7 wherein a plurality of products are positioned on each side of said support member.

9. The package of claim 7 wherein a single product is positioned on one side of said member and a plurality of products are positioned on the other side.

10. The package of claim 7 wherein the products positioned on each side of said support member are different in nature.

11. The package of claim 7 wherein the support member and said sheets are thermoplastic materials.

12. The package of claim 7 wherein the support member is flat.

* * * * *